US006037586A

United States Patent [19]

Baril

[11] Patent Number: 6,037,586

[45] Date of Patent: Mar. 14, 2000

[54] APPARATUS AND METHOD FOR SEPARATING PULSED IONS BY MASS AS SAID PULSED IONS ARE GUIDED ALONG A COURSE

[75] Inventor: Marcel Baril, Ste-Foy, Canada

[73] Assignee: Universite Laval, Quebec, Canada

[21] Appl. No.: 09/099,697

[22] Filed: Jun. 18, 1998

[51] Int. Cl.[7] ..... H01J 49/40

[52] U.S. Cl. ..... 250/287; 250/294

[58] Field of Search ..... 250/287, 281, 250/282, 294, 296

[56] References Cited

U.S. PATENT DOCUMENTS

| | | | |
|---|---|---|---|
| 3,397,311 | 8/1968 | Saari et al. | 250/41.9 |
| 4,238,678 | 12/1980 | Castleman et al. | 250/381 |
| 4,335,465 | 6/1982 | Christiansen et al. | 376/156 |
| 4,458,149 | 7/1984 | Muga | 250/287 |
| 4,754,135 | 6/1988 | Jackson | 250/287 |
| 4,904,872 | 2/1990 | Grix et al. | 250/423 |
| 4,912,327 | 3/1990 | Waugh | 250/309 |
| 5,065,018 | 11/1991 | Bechtold et al. | 250/287 |
| 5,128,543 | 7/1992 | Reed et al. | 250/287 |
| 5,136,161 | 8/1992 | Logan | 250/293 |
| 5,140,158 | 8/1992 | Post | 250/281 |
| 5,162,649 | 11/1992 | Burke | 250/287 |
| 5,164,592 | 11/1992 | Kitamori et al. | 250/288 |
| 5,180,914 | 1/1993 | Davis et al. | 250/287 |
| 5,196,708 | 3/1993 | Mullock | 250/423 |
| 5,371,366 | 12/1994 | Marui | 250/309 |
| 5,431,714 | 7/1995 | Brutscher et al. | 95/57 |
| 5,463,220 | 10/1995 | Young | 250/288 |

OTHER PUBLICATIONS

Nuclear Physics Institute, Academy of Sciences of Repubic of Kazakhstan by S.P. Karetskaya et al. "Mass–spectrometer with io multiple passage of a magnetic field".

Nuclear Instruments & Methods T. Sakurai and M. Baril (vol. 369, pp. 473–476, 1995) "Ion optics of a high resolutio multipassage mass spectrometer with electrostatic ion mirrors".

International Journal of Mass Spectrometry and Ion Processes Ching–Shen Su, (vol. 88, pp. 21–28, 1989) "Multiple reflection tyep time–of–flight mass spectrometer with two sets of parallel–plate electrostatic fields".

International Journal of Mass Spectrometry and Ion Processes, H. Wollnik and M. Przewloka, (vol. 96, pp. 267–274, 1990) "Time–of–flight mass spectrometers with multiply reflected ion trajectories".

Nuclear Instruments & Methods Trötscher et al., (vol. B70, pp. 455–458, 1992) "Mass measurements of exotic nuclei at the ESR".

International Journal of Mass Spectrometry and Ion Processes, H. Wollnik, vol. 131, pp. 387–407, 1994 "Energy–isochronous time–of–flight mass analyzers".

Nuclear Instruments & Methods in Physics Research—L.G. Glickman et al. (vol. 363, pp. 451–453, 1995) "Schemes for mass analyzers based on mirrors with two–plate electrodes".

*Primary Examiner*—Kiet T. Nguyen
*Attorney, Agent, or Firm*—Darby & Darby

[57] ABSTRACT

The apparatus and the method are for separating pulsed ions by mass as the pulsed ions are guided along a course. Each of the pulsed ions has a mass m within a range $m_{min}$ to $m_{max}$, a speed v and substantially a same energy E, where $E=\frac{1}{2}mv^2$. The pulsed ions pass a point P at a time T0. The apparatus comprises a guiding device for guiding pulsed ions along a closed circuit path; an insertion device having an insertion input for receiving ions, an insertion output for inserting ions deflected from the insertion input into the closed circuit path and a control gate for either activating or deactivating the insertion device; an extraction device having an extraction input for receiving ions guided along the closed circuit path, an extraction output for extracting ions out of the closed circuit path and a control gate for either activating or deactivating the extraction device; and a controller for controlling operation of the insertion and extraction devices.

13 Claims, 8 Drawing Sheets

| ELECTRODE | Position | Ni | TR-I | Nf | TR-F |
|---|---|---|---|---|---|
| PULSER | | | | | |
| START | 0 | 0 | HL | 10 | LH |
| END | 81 | 54 | HL | 64 | LH |
| INSERTION DEVICE | | | | | |
| START (DEFLECTOR 47) | 500 | 333 | LH | 397 | HL |
| END (DEFLECTOR 47) | 581 | 333 | LH | 397 | HL |
| START (DEFLECTOR 13) | 919 | 613 | LH | 677 | HL |
| END (DEFLECTOR 13) | 1000 | 613 | LH | 677 | HL |
| EXTRACTION DEVICE (SHORT COURSE) | | | | | |
| START (DEFLECTOR 21) | 2000 | 1333 | LH | 1397 | HL |
| END (DEFLECTOR 21) | 2081 | 1333 | LH | 1397 | HL |
| START (DEFLECTOR 70) | 2419 | 1613 | LH | 1677 | HL |
| END (DEFLECTOR 70) | 2500 | 1613 | LH | 1677 | HL |
| EXTRACTION DEVICE (LONG COURSE) | | | | | |
| START (DEFLECTOR 21) | 5000 | 3333 | LH | 3397 | HL |
| END (DEFLECTOR 21) | 5081 | 3333 | LH | 3397 | HL |
| START (DEFLECTOR 70) | 5419 | 3613 | LH | 3677 | HL |
| END (DEFLECTOR 70) | 5500 | 3613 | LH | 3677 | HL |
| | | | | | |

Figure 2

AMPLITUDE

TIME

APPARATUS AND METHOD FOR SEPARATING PULSED IONS BY MASS AS SAID PULSED IONS ARE GUIDED ALONG A COURSE

BACKGROUND OF THE INVENTION (a) Field of the Invention

The present invention is concerned with an apparatus and a method for separating ions of a pulse by their mass as said pulsed ions are guided along a course. Each of the pulsed ions has a mass m within a range $m_{min}$ to $m_{max}$, a same energy E and a speed v given by $v=(2E/m)^{1/2}$.

(b) Brief Description of the Related Art

It is known to analyse a given sample by bombarding it with an incident beam (e.g. laser, electron, fast atom or ion beam). The incident beam impacts the sample and the resulting ions, representative of the composition of the sample, are then analysed by a variety of apparatuses such as a time of flight mass spectrometer (TOFMS). In a TOFMS, the composition of the sample can be determined by analysing the masses of the ions resulting from the bombardment. The resolution of a TOFMS is dependent on its length, the speed of the ions, the duration of the pulse and the ability of the apparatus to maintain isochronicity of the travel of ions having the same mass but a slight energy difference.

Known in the art is U.S. Pat. No. 5,140,158 (Richard F. Post), which relates to an improved method and apparatus for separating ions of chosen charge-to-mass ratios from other ions with a different charge-to-mass ratio. There is illustrated a preferred embodiment of the invention showing a cross-sectional view from the side of a single module of the invention. A vacuum chamber contains an array of conducting rods supported on insulated electrical feed-throughs. At a first end of the array are located a pair of parallel plate electrodes and a collector cup which together comprise the collector assembly. At a second end of the array is located an ion source and accelerator. The apparatus induces a series of localized electrical potentials which simulate a travelling electrical potential hill travelling at a velocity with a magnitude $v_o$. Ions with a charge-to-mass ratio Z/M>k are accelerated to a velocity twice the velocity of the travelling electric potential hill while ions with a charge-to-ratio Z/M<k are not accelerated. Therefore when a travelling potential hill is applied, an ion or charge particle beam is created of ions or charge particles with a charge-to-mass ratio greater than k.

Also known in the art is U.S. Pat. No. 4,912,327 (Allen R. WAUGH) which describes a method and apparatus for producing a pulsed microfocused ion beam. The method comprises the step of deflecting the continuous ion beam by the synchronised actions of a first electric field component Ey, directed along or parallel to a y-axis, and a second electric field component Ex, directed along or parallel to an x-axis. The first electric field component Ey may be generated by applying a periodically-varying voltage waveform Vya to a first y-deflecting electrode, and a periodically-varying voltage waveform Vyb to a second y-deflecting electrode.

Also known in the art is U.S. Pat. No. 5,136,161 (Charles H. LOGAN) which describes a mass spectrometer. As a plurality of ionized particles traverse the ion current path defined by a plurality of drift tubes, a selected portion of the ionized particles will reach the first field region A at the same time that the field generated therein reaches its maximum value. These particles will receive an energy increase, and corresponding increase in velocity, that is greater than that received by ionized particles reaching the first field region A at a time when the electric field is at a magnitude less than its maximum value. Since the increase in velocity is dependent upon the mass of the ionized particle and the amount of energy added to the ionized particle, and since the mass of the synchronous particle is known, the increase in velocity for the synchronous particle is determinable.

Also known in the art there is the article entitled "Mass-Spectrometer With Ion Multiple Passage Of A Magnetic Field" published in Nuclear Physics Institute, Academy of Sciences of Republic of Kazakhstan by S. P. Karetskaya et al. This article describes the construction and the testing of a statical mass-spectrometer in which ions traverse three times a field created by a magnet, having poles shaped as regular hexagons.

Also known in the art is U.S. Pat. No. 4,458,149 (M. Luis MUGA) which describes a mass spectrometer. This invention comprises the steps of applying a time-dependent and time-varying force field to already partially separate iso-mass ion packets along their flight path.

Also known in the art are U.S. Pat. No. 4,238,678 (B. Wayne CASTLEMAN), U.S. Pat. No. 3,397,311 (J. M. SAARI et al.) and U.S. Pat. No. 5,180,914 (Stephen D. DAVIS) which describe methods and apparatuses wherein a static voltage is applied to ions.

Also known in the art are the following U.S. patents which describe different apparatuses and methods involving ion beams: U.S. Pat. Nos. 4,335,465; 4,904,872; 5,065,018; 5,162,649; 5,164,592; 5,196,708; 5,371,366; 5,431,714; and 5,463,220.

Additionally, T.Sakurai and M.Baril, in Nuclear Instruments & Methods (vol. 369, pp.473–476, 1995), have proposed a theoretical model of a closed circuit mass spectrometer. It uses electrostatic ion mirrors and a centered magnetic prism. The ions must come to a stop in an ion mirror and reflect in the reverse direction. This is troublesome for keeping the ions in the closed circuit for prolonged periods of time. In addition, it is not properly a time of flight device but a multiple pass analyser.

Also known is the work of Ching-Shen Su, in International Journal of Mass Spectrometry and Ion Processes (vol. 88, pp. 21–28, 1989), describing a time of flight mass spectrometer implying a fixed number of reflections of an ion pulse between two sets of electrostatic planes. This system does not include a closed circuit path. There is no ion focussing hence there is substantial loss of beam intensity for each reflection. For the prototype described, the maximum number of reflections achieved was 4, giving a mass resolution of only about 300 (at base peak) around mass 85.

Also known is the work of H. Wollnik and M. Przewloka, in International Journal of Mass Spectrometry and Ion Processes (vol. 96, pp.267–274, 1990), describing a system similar to the preceding one but in a folded geometry. It uses 1 permanent ion mirror and 2 switchable ion mirrors positioned to form a V path. When activated, the switchable ion mirrors hide the pulsed ion source at one end and the detector at the other end. The use of ion mirrors is troublesome for keeping the ions in the closed circuit for prolonged periods of time. There is no ion focussing nor confinement in this system hence there is substantial loss of beam intensity for each reflection. For the prototype described, the maximum number of reflections was 5, giving a mass resolution of only 720 around mass 28.

Also known is the work of Trotscher et al., in Nuclear Instruments & Methods (vol. B70, pp. 455–458, 1992), describing a hexagonal magnetic storage ring for high energy ions. This setup is of sizable dimensions (40 meters in width) and measures mass by frequency and not by time of flight. The magnetic sectors preserve momentum and not energy so that only one very precise mass gets to be stored for a certain number of turns. Also, the insertion of ions in the closed path is very difficult because it must be done across a magnetic field and subsequently corrected in the path: consequently, the insertion efficiency is of the order of 0.5% only.

There is finally known in the art, the published work of Wollnik, H. "Energy-Isochronous Time-of-Flight Mass Analyzers". This paper discusses techniques of time-of-flight mass analyzers, both for systems of reflector-type geometry and systems that employ sector fields. Wollnik does not however provide a system that allows to separate pulsed ions by mass as the pulsed ions are guided along a course in a simple, inexpensive and efficient manner while providing a variable resolution, even in a case where the ions have masses which are close to one another.

None of the above-mentioned patents or published works shows or describes the necessary means for separating pulsed ions by mass as said pulsed ions are guided and confined along a purely electrostatic course in a simple, inexpensive and efficient manner while providing a variable resolution. This is especially true if one wants to separate ions having very close masses.

OBJECT AND SUMMARY OF THE INVENTION

Therefore, an object of the present invention is to provide a method and an apparatus for separating pulsed ions by mass as the pulsed ions are guided and confined along a course in a simple, inexpensive and efficient manner while providing a variable resolution, even in a case where the ions have masses which are close to one another.

According to the present invention, there is provided an apparatus for separating ions of a pulse by mass as said ions are guided along a course, each of the ions having a mass m within a range $m_{min}$ to $M_{max}$, a same energy E, and a speed v given by $v=(2E/m)^{1/2}$, the ions passing a point P at a time T0, said apparatus comprising:

guiding means for energy-isochronally guiding ions of a same mass along a closed circuit path having a course length L;

insertion means having an insertion input for receiving the ions, an insertion output for inserting the ions deflected from the insertion input into the closed circuit path and a first control gate for either activating or deactivating the insertion means, the insertion input being located at a distance L1 from the point P;

extraction means having an extraction input for receiving the ions guided along the closed circuit path, an extraction output for extracting the ions out of the closed circuit path and a first control gate for either activating or deactivating the extraction means, the extraction input being located at a course distance L2 from the insertion input; and controlling means having:

a first output for sending a first control signal to the first control gate of the insertion means at a time T1, to activate the insertion means and consequently insert the ions present at the input thereof, T1 being chosen within limits defined by the following equation:

$$T0 \leqq T1/<T0+L1v_{max}, \text{ where } v_{max}=(2E/m_{min})^{1/2};$$

a second output for sending a second control signal to the first control gate of the insertion means to deactivate the insertion means at a time T2, T2 being chosen within limits defined by the following equation:

$$T0+L1/v_{min}<T2<T0+(L+L1)/v_{max}, \text{ where } v_{min}=(2E/m_{max})^{1/2};$$

a third output for sending a third control signal to the first control gate of the extraction means at a time T3 to activate the extraction means and consequently extract the ions present at the input thereof, T3 being chosen within limits defined by the following equation:

$$T0+L1/v_{min}+(((n-1)L+L2)/v_{min})<T3<T0+L1/v_{max}+(nL+L2)/v_{max},$$

where n is a number of turns the pulsed ions travel within the closed circuit path; and a fourth output for sending a fourth control signal to the first control gate of the extraction means at a time T4 to deactivate the extraction means, T4 being chosen within limits defined by the following equation:

$$T0+L1/v_{min}+((nL+L2)/v_{min})<T4.$$

According to the present invention, there is also provided a method for separating ions of a pulse by mass as said ions are guided along a course, each of the ions having a mass m within a range $m_{min}$ to $m_{max}$, a same energy E, and a speed v given by $v=(2E/m)^{1/2}$, the ions passing a point P at a time T0, said method comprising steps of:

inserting a pulse of ions into a closed circuit path by means of insertion means having an insertion input for receiving the ions, an insertion output for inserting the ions deflected from the insertion input into the closed circuit path and a first control gate for either activating or deactivating the insertion means, the insertion input being located at a distance L1 from the point P;

energy-isochronally guiding ions of a same mass along the closed circuit path having a course length L;

extracting the pulse of ions out of the closed circuit path by means of extraction means having an extraction input for receiving the ions guided along the closed circuit path, an extraction output for extracting the ions out of the closed circuit path and a first control gate for either activating or deactivating the extraction means, the extraction input being located at a course distance L2 from the insertion input;

sending a first control signal to the first control gate of the insertion means at a time Ti, to activate the insertion means and consequently insert the ions present at the input thereof, T1 being chosen within limits defined by the following equation:

$$T0 \leqq T1<T0+L1/v_{max}, \text{ where } v_{max}=(2E/\text{min})^{1/2};$$

sending a second control signal to the first control gate of the insertion means to deactivate the insertion means at a time T2, T2 being chosen within limits defined by the following equation:

$$T0+L1/v_{min}<T2<T0+(L+L1)/v_{max}, \text{ where } v_{min}=(2E/m_{max})^{1/2};$$

sending a third control signal to the first control gate of the extraction means at a time T3 to activate the extraction means and consequently extract the ions present at the input thereof, T3 being chosen within limits defined by the following equation:

$$T0+L1/v_{min}+(((n-1)L+L2)/v_{min})<T3<T0+L1/v_{max}+(nL+L2)/v_{max},$$

where n is a number of turns the pulsed ions travel within the closed circuit path; and sending a fourth control signal to the first control gate of the extraction means at a time T4 to deactivate the extraction means, T4 being chosen within limits defined by the following equation:

$$T0+L1/v_{min}+((nL+L2)/v_{min})<T4.$$

The objects, advantages and other features of the present invention will become more apparent upon reading of the following non restrictive description of preferred embodiments thereof, given for the purpose of exemplification only with reference to the accompanying drawings.

BRIEF DESCRIPTION OF THE DRAWINGS

FIG. 2 is a table showing experimental parameters;

DESCRIPTION OF PREFERRED EMBODIMENTS OF THE INVENTION

Figure 1:
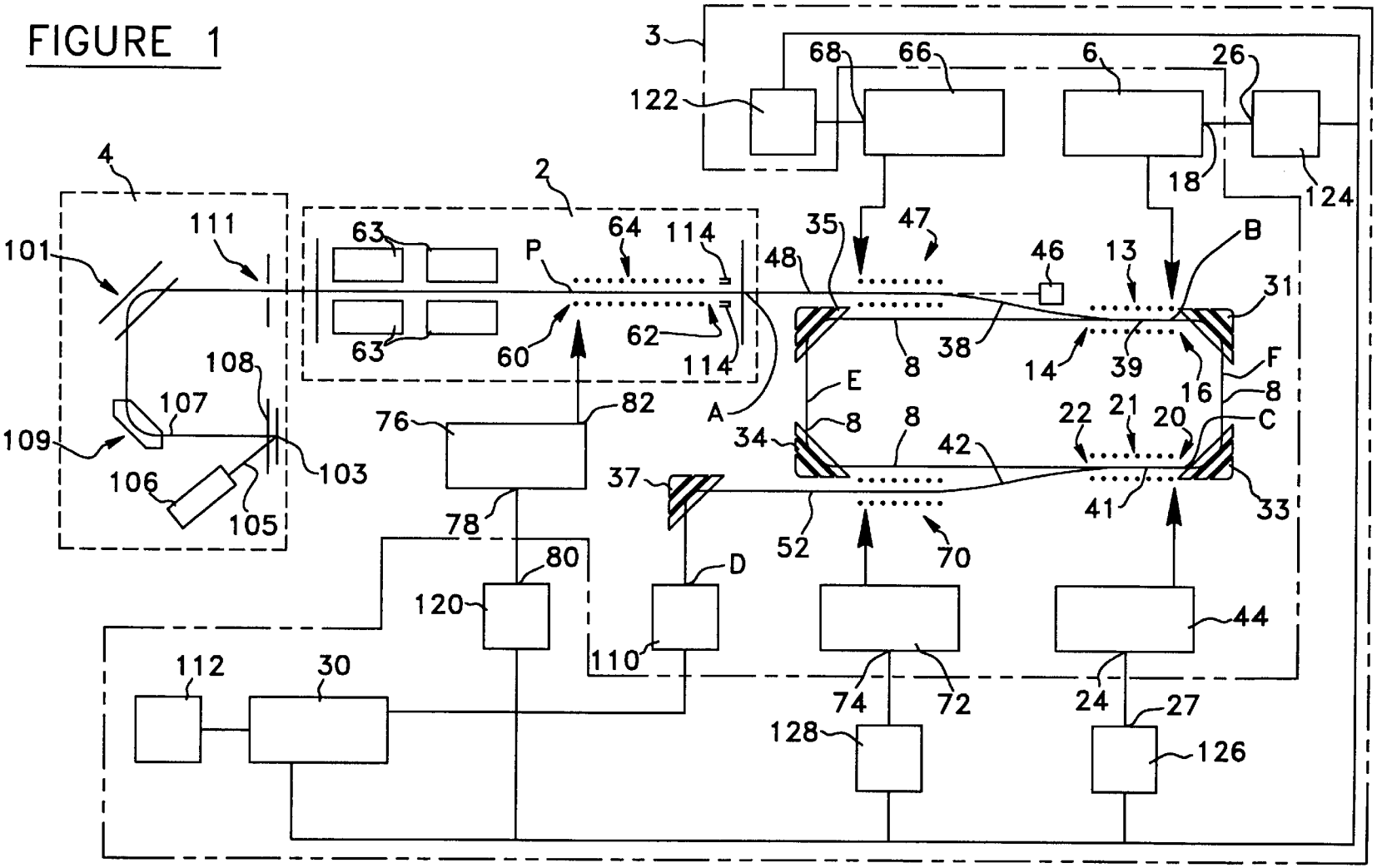
FIG. 1 is a block diagram showing an apparatus for separating pulsed ions by mass, the apparatus including a pulser for producing a pulsed ion beam, and an apparatus for producing an ion beam wherein the ions have substantially a same energy E.

In the following description of the drawings, the same reference numerals refer to the same structural elements.

Referring to FIG. 1, there is shown an apparatus for separating ions of a pulse by mass as the pulsed ions are guided along a course. The ions are launched from a point P at a time T0 and are directed toward the apparatus. The apparatus generally comprises a guiding device, an insertion device and an extraction device. The guiding device is for guiding pulsed ions along a closed circuit path 8 which has a course length L. The insertion device comprises a deflector 13 having an insertion input 14 for receiving ions, an insertion output 16 for inserting ions deflected from the insertion input 14 into the closed circuit path 8, and a control gate 18 for either activating or deactivating the insertion device.

The insertion input 14 is located at a distance L1 from the point P.

The extraction device comprises a deflector 21 having an extraction input 20 for receiving ions guided along the closed circuit path 8, an extraction output 22 for extracting ions out of the closed circuit path 8, and a control gate 24 for either activating or deactivating the extraction device. The extraction input 20 is located at a course distance L2 from the insertion input 14.

Preferably, the apparatus according to the invention is used for the analysis of ions produced by bombarding a sample by means of any appropriate source that generates a continuous primary beam (photons, ions, electrons, fast atoms or molecules). A continuous ion beam is produced by the bombardment of the sample by the continuous primary beam. FIG. 1 shows an apparatus 4 for producing such an ion beam wherein the ions have substantially a same energy E. Each of the resulting ions has a mass m and a speed v given by $v=(2E/m)^{1/2}$.

If the ion beam to be analysed is continuous, the apparatus for separating ions includes a pulser 2 for producing a pulsed ion beam. The continuous ion beam enters into the pulser 2 which deflects most of the ions towards collectors 114 by applying an electric field between the facing electrodes of a deflector 64. However, for a small zone and a short period of time, the electric field is nil so that a certain amount of ions continues their course without being deflected. The ion pulse created in this manner moves towards the exit of the pulser as the zone moves progressively to the end of the deflector 64.

Following the pulser on the path of the pulsed ions is a deflector 47 for deflecting pulsed ions arriving along an axis 48 into an axis 38. This deflector 47 is a part of the insertion device. The insertion device further includes the deflector 13 located on one of the sides of the closed circuit path 8. The deflector 13 is for deflecting pulsed ions arriving along the axis 38 into an axis 39 included in the closed circuit path 8. The axis 39 forms an obtuse angle with respect to the axis 38, and is parallel to the axis 48. The deflector 13 comprises facing electrodes which will be described with more detail later on.

The extraction device includes the deflector 21 5 located on another side of the closed circuit path 8. The deflector 21 is for deflecting pulsed ions arriving along an axis 41 included in the closed circuit path 8 into an axis 42 out of the closed circuit path 8. The axis 42 forms an obtuse angle with respect to the axis 41. The extraction device further includes a deflector 70 for deflecting pulsed ions arriving along the axis 42 into an axis 52.

The guiding device includes four deflecting devices 31, 33, 34 and 35 located at the corners of a rectangular shape to guide the pulsed ions along a generally rectangular closed circuit path 8. The closed circuit path 8 has two opposite long sides and four rounded corners. Each of the deflecting devices 31, 33, 34 and 35 deflects the pulsed ions at substantially a 90° angle. Of course, various shapes could be given to the closed circuit path 8 without departing from the scope of the present invention.

The pulsed ions are guided along the closed circuit path 8 isochronally. Isochronous means that the ions having the same mass take the same time to complete a turn within the closed circuit path 8, even if they have slightly different energies. For example, isochronous guiding means can use grid-free mirrors such as those mentioned in the article entitled "Schemes For Mass Analyzers Based On Mirrors With Two-Plate Electrodes" published in Nuclear Instruments And Methods In Physics Research A 363 (1995) 451–453 by L. G. Glickman et al. Other ion optics elements could also be used; the timing scheme should be adapted to the particular elements employed to construct the isochronous guiding device since these may affect differently the instantaneous speed of the travelling ions inside the closed circuit path.

In this particular embodiment of the invention, each of the deflecting devices 31, 33, 34 and 35 is a grid-free mirror. Another grid-free mirror 37 is provided for deflecting pulsed ions coming from the deflector 70 along the axis 52. This grid-free mirror 37 is external to the closed circuit path 8 and has characteristics complementary of the grid-free mirrors 31 and 33, located in the last half of the closed circuit path 8 for maintaining an isochronous propagation among the pulsed ions extracted from the closed circuit path 8. Most of the time, when the pulsed ions do several turns within the closed circuit path 8, it would be possible to operate the apparatus without the grid-free mirror 37 and the overall precision would not be affected in a significant manner. However, for the cases when one or only a few turns are performed by the pulsed ions within the closed circuit path 8 then the presence of the grid-free mirror 37 is preferable to improve the precision of the apparatus.

It should be noted that additional grid-free mirrors can be added in the ion path exterior to the closed circuit path 8, for example between the pulser 2 and the input 14 of the deflector 13, to compensate for the speed difference of ions of different masses within a pulse.

For separating ions having masses very close to each other, the apparatus should be set to obtain a very high resolving power. This resolving power is proportional, to a first approximation, to the number of turns completed by the ion pulses within the closed circuit path 8. The total course length of the ions travelling within the closed circuit path 8 can be varied easily by controlling the moments when the deflectors 13 and 21 are put into operation.

The deflectors 47 and 13 are used for inserting the ion pulses within the closed circuit path 8 as deflectors 21 and 70 are used for extracting the ion pulses therefrom. Normally, during an experiment, to increase the duty cycle, several ion pulses are deflected within the closed circuit path 8 to be analysed. The distance between the successive ion pulses and the appropriate delays are determined by the resolving power that is required and depends essentially on the masses of the ions as will be hereinafter explained.

The apparatus for separating also comprises a controller 3. The controller 3 comprises a clock 112, a central timing unit 30 and delay generators 120, 122, 124, 126 and 128.

The controller 3 has an output 26 at delay generator 124, for sending a first control signal to the control gate 18 of the insertion device at a time T1 to activate it and consequently insert ions present at the input thereof. The output 26 is also for sending a second control signal to the control gate 18 of the insertion device to deactivate it at a time T2.

The insertion device includes a DC voltage generator 6 for applying a first DC voltage between the first pair of facing electrodes of the deflector 13 upon reception of the first control signal on the control gate 18 of the insertion device. The first DC voltage is removed when the second control signal is applied to the control gate 18. The same voltage is applied and removed successively to all pairs of facing electrodes of deflector 13 with the appropriate delays.

The controller 3 also has an output 27 at delay generator 126, for sending a third control signal to the control gate 24 of the extraction device at a time T3 to activate it and consequently extract ions present at the input thereof, and for sending a fourth control signal to the control gate 24 of the extraction device at a time T4 to deactivate it.

The extraction device includes a DC voltage generator 44 for applying a DC voltage between the first pair of facing electrodes of the deflector 21 upon reception of the third control signal on the control gate 24. The DC voltage applied by the generator 44 is removed when the fourth control signal is applied to the control gate 24. The same voltage is applied and removed successively to all pairs of facing electrodes of deflector 21 with the appropriate delays.

The controller 3 also comprises a calculating device for calculating times T1, T2, T3 and T4 from time T0 and selecting times T1, T2, T3 and T4 within operational limits according to the following equations:

$$T0 \leqq T1 < T0 + L1/v_{max}, \text{ where } v_{max} = (2E/m_{min})^{1/2};$$

$$T0 + L1/v_{mim} < T2 < T0 + (L+L1)/v_{max}, \text{ where } v_{min} = (2E/m_{max})^{1/2};$$

$$T0 + L1/v_{min} + (((n-1)L + L2)/v_{min}) < T3 < T0 + L1/v_{max} + (nL + L2)/v_{max},$$

where n is the number of turns the pulsed ions travel within the closed circuit path 8; and $$T0 + L1/v_{min} + ((nL + L2)/v_{min}) < T4.$$

It is understood that the above-defined limits are the largest time windows possible, corresponding to the case where a single pulse circulates in the closed circuit 8. In operation, it is usually advantageous to introduce a maximum number of pulses in the circuit path 8; then the time limits must be restricted to take into consideration the passage of all the pulses at each point.

The calculating device is implemented by means of the central timing unit 30 provided with the appropriate calculating software.

The insertion device further includes another DC voltage generator 66 for applying a DC voltage between the first pair of facing electrodes of the deflector 47, upon reception of a fifth control signal on control gate 68 of the insertion device. The DC voltage applied by the generator 66 is removed when a sixth control signal is applied to the control gate 68. The same voltage is applied and removed successively to all pairs of facing electrodes of deflector 47 with the appropriate delays. The fifth and sixth control signals are generated by the delay generator 122 of the controller 3.

The extraction device further includes another DC voltage generator 72 for applying a DC voltage between the first pair of facing electrodes of the deflector 70 upon reception of a seventh control signal on control gate 74 of the extraction device. The DC voltage applied by the generator 72 is removed when an eighth control signal is applied to the control gate 74. The same voltage is applied and removed successively to all pairs of facing electrodes of deflector 70 with the appropriate delays. The seventh and eighth control signals are generated by the delay generator 128 of the controller 3.

Figures 3A, 3B, 3C, 3D, 3E:
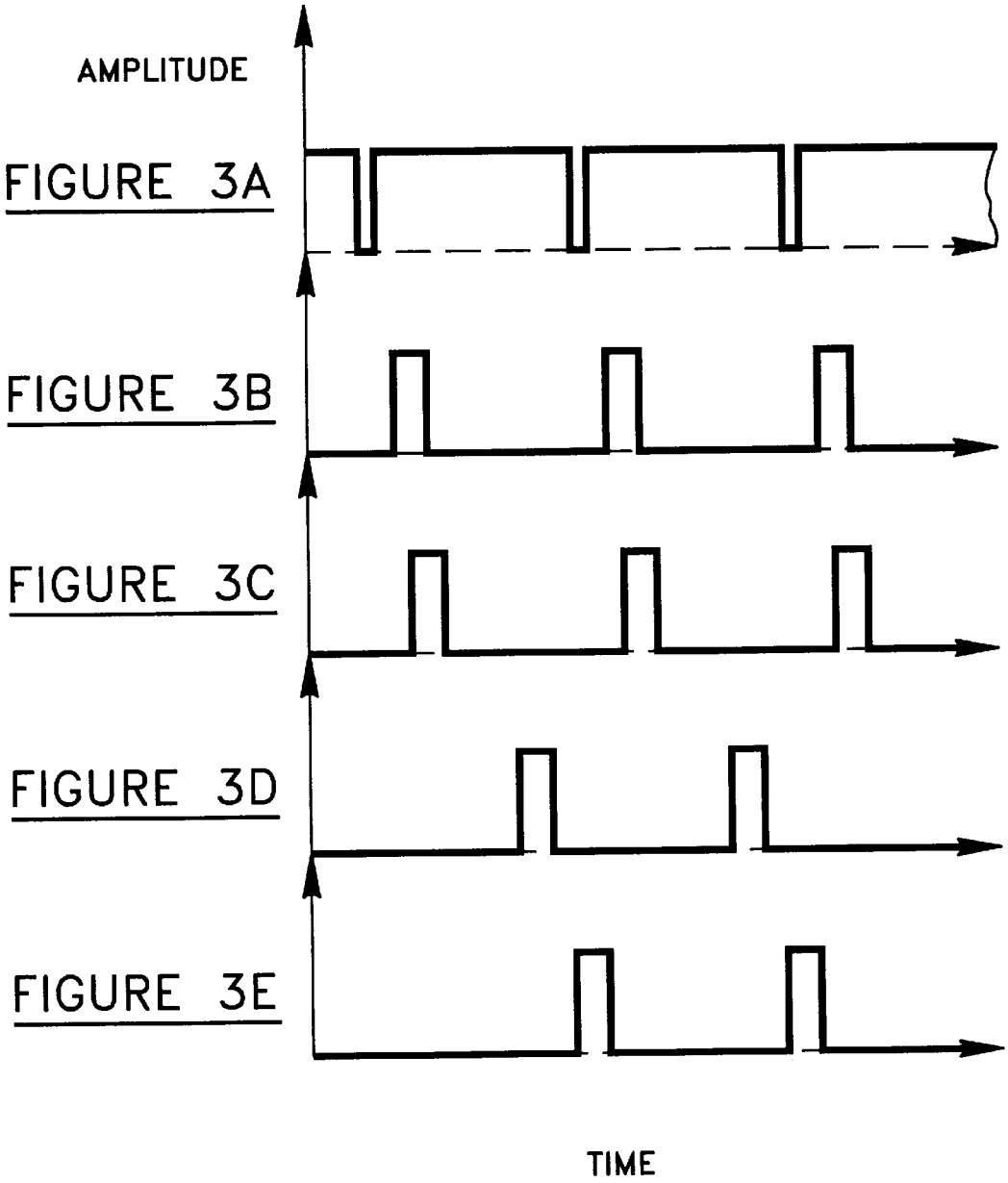
FIGS. 3A, 3B, 3C, 3D, and 3E show signal diagrams for use in the apparatus of FIGS. 1 and 7.
Figure 5:
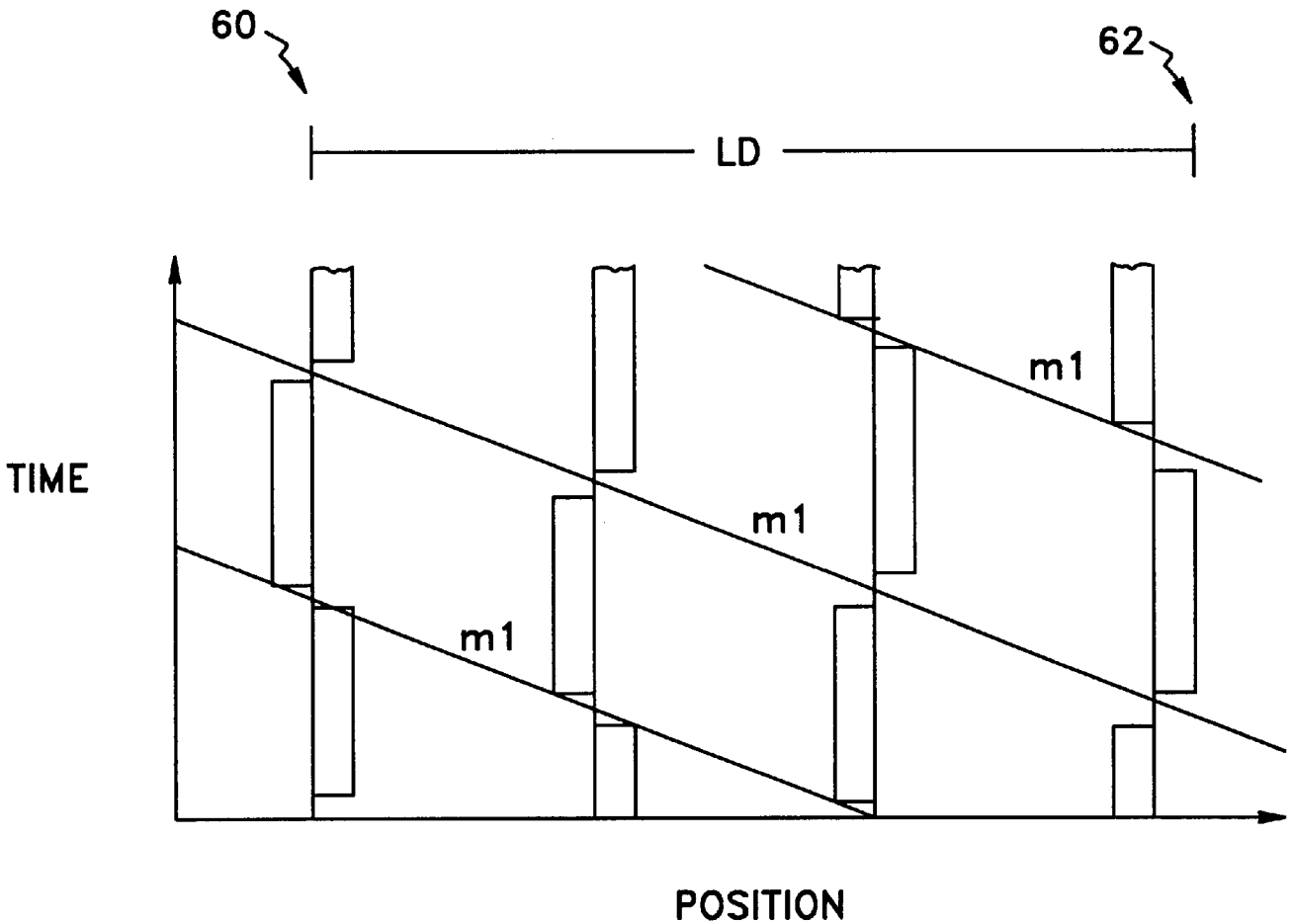
FIG. 5 is a signal diagram in relation to FIG. 1 and 4.

Referring now to FIGS. 1, 3A, 3B, 3C, 3D, 3E, and 5 we will now describe the temporal synchronization of the apparatus. Each of the zero volt signals shown in FIG. 3A is applied to the input of the generator 76 which, for each zero volt signal that is received, generates a travelling nil potential window as shown in FIG. 5. The width of this window is operator adjustable and defines the pulse duration. Only those ions with the proper speed follow the travelling window through the pulser. In the normal mode of operation, the pulser 2 deflects the ion beam in a periodic manner to create pulses of undeflected ions. The deflectors 47, 13, 21 and 70 are operated in a different manner in that they are only activated when their deflecting action is needed. The voltages produced by the generators 66, 6, 44 and 72 are respectively shown in FIGS. 3B, 3C, 3D and 3E. The time delays are very important because they determine the insertion and the extraction of the ion pulses in and out of the closed circuit path 8.

The method for separating ions of a pulse by mass comprises steps of:

inserting a pulse of ions into a closed circuit path 8 by means of insertion device having an insertion input 14 for receiving the ions, an insertion output 16 for inserting the ions deflected from the insertion input 14 into the closed circuit path 8, and a control gate 18 for either activating or deactivating the insertion device;

energy-isochronally guiding ions of a same mass along the closed circuit path 8; and extracting the pulse of ions out of the closed circuit path 8 by means of extraction device having an extraction input 20 for receiving the ions guided along the closed circuit path 8, an extraction output 22 for extracting the ions out of the closed circuit path 8, and a control gate 24 for either activating or deactivating the extraction device.

The method also comprises steps of:

sending a first control signal to the control gate 18 at a time T1 to activate the insertion device and consequently insert the ions present at the input thereof, T1 being chosen within limits defined by the following equation:

$$T0 \leqq T1 < T0 + L1/v_{max}, \text{ where } v_{max} = (2E/m_{min})^{1/2};$$

sending a second control signal to the control gate 18 to deactivate the insertion device at a time T2, T2 being chosen within limits defined by the following equation:

$$T0 + L1/v_{min} < T2 < T0 + (L+L1)/v_{max}, \text{ where } v_{min} = (2E/m_{max})^{1/2};$$

sending a third control signal to the control gate 24 at a time T3 to activate the extraction device and consequently extract the ions present at the input thereof, T3 being chosen within limits defined by the following equation:

$$T0 + L1/v_{min} + (((n-1)L + L2)/v_{min}) < T3 < T0 + L1/v_{max} + (nL + L2)/v_{max},$$

where n is a number of turns the pulsed ions travel within the closed circuit path; and sending a fourth control signal to the control gate 24 at a time T4 to deactivate the extraction device, T4 being chosen within limits defined by the following equation:

$$T0 + L1/v_{min} + ((nL + L2)/v_{min}) < T4.$$

The course length L is understood for the present invention as an equivalent length at the nominal speed of the travelling ions in free space since a specific embodiment of the isochronous guiding device may affect the instantaneous speed of the said ions. Also, multiple pulses may be inserted in the closed circuit path to increase the duty cycle of the apparatus, in which case the timing scheme should be adjusted to avoid interferences between travelling ion pulses.

Preferably, the step of inserting comprises the step of deflecting pulsed ions arriving along axis 38 into axis 39 included in the closed circuit path 8. The axis 39 forms an obtuse angle with respect to the first axis 38. Also preferably, the step of extracting comprises the step of deflecting pulsed ions arriving along axis 41 included in closed circuit path 8 into axis 42 out of the closed circuit path 8. The axis 42 forms an obtuse angle with respect to the axis 41.

Also preferably, the step of inserting further comprises, before the step of deflecting pulsed ions arriving along axis 38, a step of deflecting pulsed ions arriving along axis 48 into axis 38. The axis 48 is parallel to axis 39. Also preferably, the step of extracting further comprises, after the step of deflecting pulsed ions into axis 42, a step of deflecting pulsed ions arriving along axis 42 into axis 52. The axis 52 is parallel to axis 41.

We will now describe a practical operation of the apparatuses shown in FIG. 1, which constitute a mass spectrometer having a time of flight that can be varied by the operator. First we will examine the course that goes from point P to point D. This course has a minimum length $L_{min}$ defined by the following equation:

$$L_{min} = PB + BFC + CD$$

but this course can also have a longer length of $L_{max}$ defined by the following equation:

$$L_{max} = PB + BFC + n(CEBFC) + CD$$

where n(CEBFC) represents n turns in the closed circuit 8.

The mass spectrometer can have the following practical parameters PB=1m, BFC=1m, CEBFC=3m and CD=1m so that $L_{min}$ is 3m and $L_{max}$ is 3(n+1)m where n=0, 1, 2, 3, . . . etc.

In a first example of the operation of the apparatus, we consider the continuous ion beam 107 to be made of positive Rubidium ions having two isotopes, 85 and 87 daltons. They are accelerated by a potential difference of 400 volts and each has one electric charge. Their kinetic energy will thus be 400 electronvolts (eV). Knowing that 1 eV=$1{,}6\times10^{31\ 19}$ joule and that 1 dalton=$1.66\times10^{-27}$ kg, it is possible to calculate the speed of these ions by using the relation:

$$v(\text{m/s}) = \sqrt{\frac{2E_k(\text{J})}{m(\text{kg})}} = \sqrt{\frac{2qV(\text{eV})}{m(\text{dalton})} \times \frac{1.6\times10^{-19}}{1.66\times10^{-27}}}$$

$$v(\text{m/s}) = 13884\sqrt{\frac{qV(\text{eV})}{m(\text{dalton})}}$$

we find by using the appropriate values for the masses 85 and 87 the following respective speeds $v_{85}=3{,}0119\times10^4$ m/s, and $v_{87}=2{,}9770\times10^4$ m/s. The mass 85 travels the 3 metres in 99.60 $\mu$s and the mass 87 travels the 3 metres in 100.77 $\mu$s The time interval between the masses 85 and 87 is 1.17 $\mu$s after the ions have travelled along the minimum length $L_{min}$. This time interval is sufficient for separating these masses. It requires a resolving power of about 100. This resolving power is estimated by dividing the time required for the ions to travel around the closed circuit path 8, in this case about 100 $\mu$s, by twice the period T of the pulse. If we set the period T at 0.5 $\mu$s we can obtain the required resolving power of 100.

This choice of a period T of 0.5 $\mu$s allows the use of a current around $2\times10^{-13}$ A. Since one charge corresponds to about $10^{-19}$C, there would then be at least one ion in the pulse.

As a second example, if we use the same operating setting for separating iron isotopes Fe (58) and nickel isotopes Ni (58) we will have a much different situation since the nickel isotope has a mass superior to the one of the iron isotope by only 0.00207 dalton. Thus the mass difference is one thousand times less than the one of the above rubidium case. In the present case, to obtain the same separation, roughly one thousand turns are required (800 more exactly). Also, this implies that the successive ion pulses have to be separated by circa 100 $\mu$s (more exactly 70 ms) instead of 100 $\mu$s if we allow only one pulse of ions at the same time in the closed circuit path. But several pulses can still travel simultaneously within the closed circuit path if appropriate management of them is done. If the primary ion beam is ten times more intense, we can reduce the duration of the initial pulses as well as the number of turns by a factor of ten. We can then obtain a resolving power of 100 000 with period T of 50 ns and one hundred turns within the closed circuit path. However, the duration of the incoming ion pulses should not be reduced under the limit at which at least one ion is present in each pulse in order to get the optimum duty cycle. If the ion current can be increased by another factor of five, we can reduce the period T to 10 ns and set the insertion and extraction devices so that the ions perform only 20 turns within the closed circuit path to still obtain the same resolving power of 100 000. The only requirement is that the detector 110 be able to separate the arrivals of two successive ions within the allowed time delay of about 20 ns. This time delay is twice the duration of the pulses emitted by the electron multiplier that is used as the detector 110. If we use micro-channels, the pulse duration can be reduced to 500 ps.

In order to determine the composition of any given sample, the sample is bombarded by means of the continuous primary beam 105. The continuous ion beam 107 that results from this bombardment is representative of the composition of the sample located at point 103 and contains ions having different masses. The ions of the continuous ion beam 107 are accelerated by means of a uniform electric field produced by two electrode plates 108. One of the plates is the sample or its support and the other is provided with a grid to allow a passage for the accelerated ions. A magnetic prism 109 separates the ion beam 107 relatively to the momentum of each ion and an electrostatic mirror 101 produces a double focusing, in terms of angle and energy towards an output slit 111 and the pulser 2 thereafter.

FIG. 1 shows the pulser 2 for producing pulsed ions. The input of the pulser 2 can be considered as being located at the point P. The pulser 2 comprises an input 60 for receiving a continuous ion beam, a deflector 64 and an output 62 for outputting pulsed ions.

Figure 4:
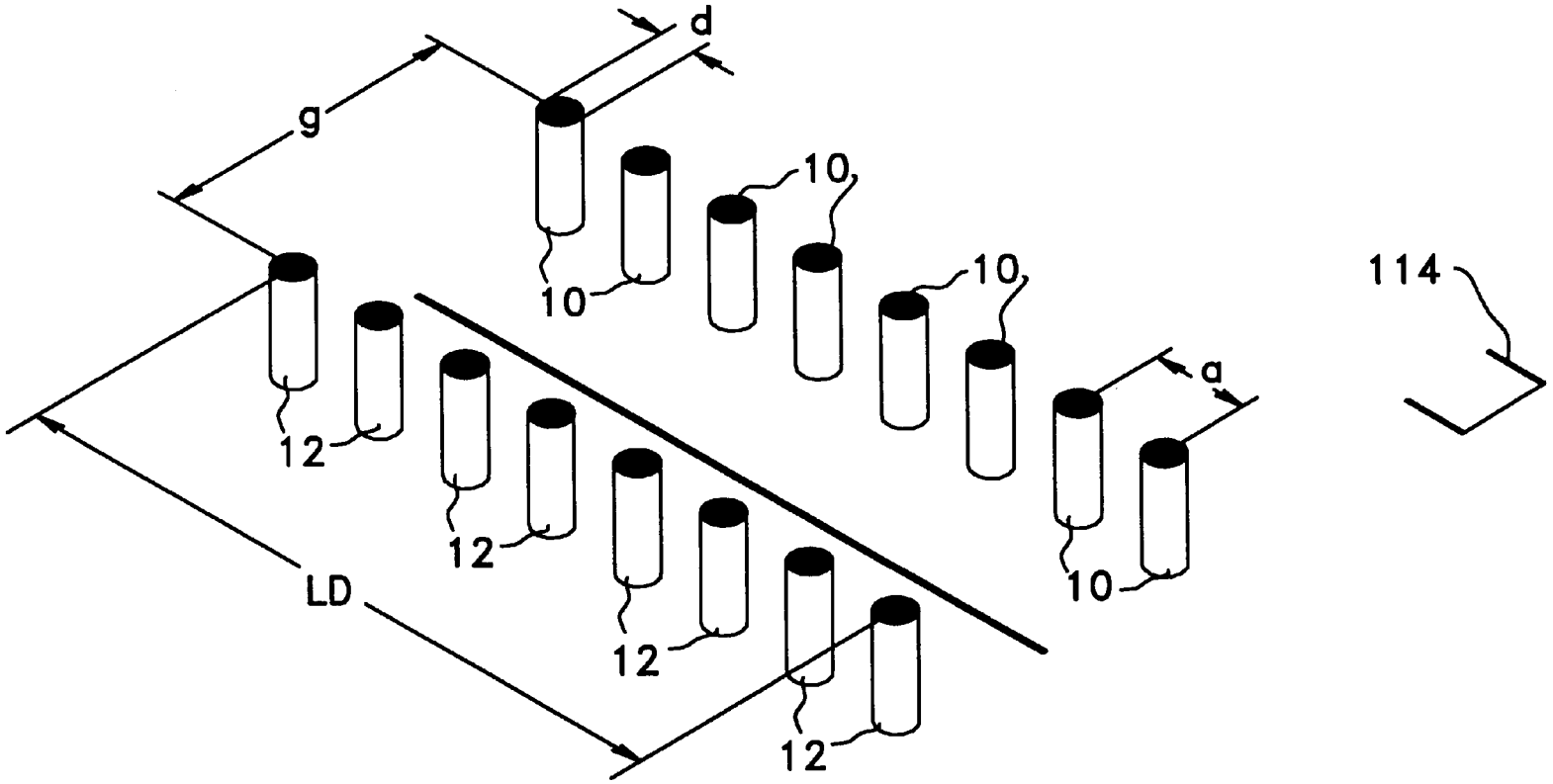
FIG. 4 is an enlarged view of the deflection means shown in FIG. 1 according to a preferred embodiment.

Referring to FIG. 4, we will now describe a preferred embodiment of the deflector 64, as well as the deflectors 47, 13, 21 and 70 mentioned above. The facing electrodes of each deflector comprises pairs of facing first and second electrodes 10 and 12. Each of the electrodes 10 and 12 is an electric wire. The first electrodes 10 are parallel and lie in a first plane. The second electrodes 12 are also parallel and lie in a second plane facing the first plane. The planes are located on both sides of a path 44 along which the ions travel.

Preferably, each of the electrodes 10 and 12 has a width of substantially 0.8 mm. Adjacent electrodes of the first electrodes 10 and adjacent electrodes of the second electrodes 12 are separated by a distance of substantially 1.5 mm. The planes are separated by a distance of substantially 1 cm. Please note that the above-mentioned values are given as an example. Depending on the situation these values can vary greatly.

Referring again to FIG. 1, the deflector 64 of the pulser 2 is located between the input 60 and the output 62 along the path along which the ions travel within the pulser 2. The material structure of this deflector is similar to the one shown in FIG. 4 and described above. A DC voltage generator 76 is provided for controlling the deflector 64. It has a command input 78 for receiving a control signal from the output 80 of the delay generator 120 of the controller 3, and a DC voltage output 82 connected to the electrodes of the deflector 64 for applying a DC voltage between the pairs of electrodes thereof. The continuous ion beam is pulsed by applying a discontinuous electric field along the path between the input 60 and the output 62 by means of the electrodes of the deflector 64. The pulser 2 also comprises quadripolar lenses 63 for horizontally and vertically focussing the incoming ion beam.

The timing of the signals controlling each of the deflectors in the present embodiment of the invention is measured in periods of the clock 112. Two characteristics of a typical experiment determine the clock period of the clock 112. The first characteristic is the distance between two successive pairs of wires in each of the deflectors 64, 47, 13, 21 and 70, assuming that they have all the same material structure. The second characteristic is the speed of the pulsed ions. The distance between successive pairs of wires is in the order of millimetres while the speed of pulsed ions is in the order of $3\times10^4$ m/s. If we set the distance at 1.5 mm, or 0.0015 m, the time to pass from one wire to another is 50 ns. We can consider this value of 50 ns as typical of the clock period necessary and sufficient to control the synchronization of the whole apparatus. We can then set the frequency of the clock 112 at 20 MHz.

We will now set the parameters of the pulser 2. We set the ion pulse duration at 0.5 $\mu$s. This duration is equivalent to 10 clock periods, and corresponds to a length of 15 mm or the distance covered by ten center-to-center electrode wire intervals.

At the starting time t0, the voltage applied on the first pair of wires is reduced to zero to obtain a nil electric field. This first pair of wires is maintained in this state for ten clock periods and then a voltage is applied on the first pair of wires to produce a deflecting electric field. For the second pair of wires, a nil electric field only occurs between the second and the twelfth clock period. For the third pair of wires, the nil field only occurs between the third and the thirteenth clock period. For the nth pair of wires the nil field only occurs between the nth and the (n+10)th clock period. Since the travelling electric field is nil, the length of the deflector has no significance in the production of the pulsed ions.

Outputs of shift registers located in voltage generator 76 and connected in series are respectively connected to the pairs of wires of each deflector to propagate a travelling nil electric field from its beginning to its end. When no ion pulse is produced, the outputs of the shift registers are kept energized. The duration of the travelling nil electric fields is chosen in relation to the resolving power that is desired.

We will now set the parameters of the deflectors 47, 13, 21 and 70. We set the distance g between the two planes of facing electrodes at 1 cm, the electric field that is produced at 10 volts/cm, and the lateral displacement resulting from the deflection at 4 mm. Each ion is then submitted to lateral kinetic energy of 4 eV which represents 1% of the axial kinetic energy. The tangent of the angle between the central axis of the deflector and that of the deflected ions is 0.1 which corresponds to the square root of the ratio of the lateral and longitudinal energies. This tangent corresponds to an angle of about 0.1 rad which is equivalent to six degrees. Each deflected ion must travel in the electric field a distance of about 80 mm along the central axis, which is about twenty times greater than its lateral displacement of 4 mm. This means that the longitudinal displacement requires fifty-five pairs of wires covering 81 mm.

Each of the deflectors has preferably the same material structure as the one shown in FIG. 4. It is preferable to locate the deflector 47 as close as possible to point A to increase as much as possible the distance between the two deflectors 47 and 13. The requirements of the voltage applied to the electrodes of the deflector 47 are simple in that it is only necessary that the ion pulse be submitted to a deflecting electric field during all of its passing through the deflector 47, and the voltage applied to the electrode can be constant.

In an alternative embodiment, where there is no pulser 2 because the incoming ions are already pulsed, the deflector 47 can be used for selecting ion pulses out of the incoming pulses. In that case, the voltage applied to the electrodes thereof is dynamic which means that it is not constant. In a case where the deflector 47 also controls the delay between two successive ion pulses entering the closed circuit path 8, the deflector 47 is then controlled in such a way that its deflecting electric field be cancelled before the arrival of any undesired ion pulse which will continue its course along a straight line toward a collector 46. The electronic circuitry for controlling this deflector 47 is quite simple because all of the pairs of wires are controlled simultaneously with a single voltage control signal.

By having the deflector 47 operated in an intermittent mode and located at a known distance from the collector 46 along a same common straight axis, then it is possible to evaluate experimentally the speed of the ions. When the ion speed is known, it is possible to predict the arrival of the ion pulse at any given position of the system by a simple rule of three from the number of clock pulses associated to the course time of the known distance between deflectors 47 and 64.

The deflector 13 is subjected to an intermittent control. As for the deflector 47, the same voltage control signal can be applied simultaneously to all of the pairs of wires thereof if only one pulse travels within the closed circuit path. But it is preferable that the deflecting electric field should be present only in a small region around the moving pulse to be deflected into the closed circuit thus avoiding to the pulse already in the closed circuit to be disturbed.

The deflector 21 is controlled in an intermittent manner in that a constant voltage cannot be applied continuously to the electrodes thereof. The deflecting effect must only occur at the moment when the ion pulse must be extracted from the closed circuit path 8. As the range of ion masses within an ion pulse is relatively narrow, and if there is only one pulse in the closed circuit path, it is sufficient to wait for the moment when all of the ions of the pulse have passed the deflector 21 and reached an acceptable distance therefrom to apply simultaneously to all of its pairs of wires the necessary voltage to produce the appropriate deflection of the ion pulse towards the axis 42 during its next passage through the deflector 21. But if there are many ion pulses in the closed circuit it is preferable that the deflecting electric field be present only in a small area around the moving pulse to be deflected out of the closed circuit path thus avoiding for the pulses already in the closed circuit path to be disturbed. The deflector 70 can be static in that a constant voltage can be applied continuously to the electrodes thereof.

The deflectors 47 and 70 respectively associated with the generators 66 and 72 can be replaced by electrostatic deflectors. However, in this case, it is recommended that the material structure of deflectors 47 and 70 be similar to those of the deflectors 13 and 21 so that it is easier to obtain a symmetrical deflecting effect on the pulsed ions which then follow a trajectory along two successive inversed parabolic curves when they are entering into the closed circuit path and when they are moving out of the closed circuit path.

By referring to FIGS. 1 and 2, we will now describe the propagation of a typical ion pulse having a speed of approximately $3\times10^4$ m/s within the mass spectrometer. In the table of FIG. 2, Ni means clock pulse where the initial transition occurs, Nf means clock pulse when the final transition occurs, TR-I means the initial transition and TR-F means the final transition. LH means a transition from low to high and HL means transition from high to low. Position means the position of a given point in mm from point P of the pulser 2.

Considering that there is a distance of one meter between point P and the output of the deflector 13, there is a course time for this distance of 33.3 $\mu$s which corresponds to 667 clock pulses. The end of the ion pulse leaves the deflector 13 after a period of time of 0.5 $\mu$s, neglecting the spread of the pulse between the points P and B. The whole ion pulse will thus have passed the point B for a first time at the 667th clock pulse. The electric field produced by the deflector 13 can then be cancelled if the ion pulse has to travel within the closed circuit path 8 for a certain number of turns. However, it is the deflector 21, which is located at a course distance of one meter from the deflector 13, that determines whether the ion pulse will continue within the closed circuit path 8 or will be switched towards the detector 110. If no deflecting field is applied on the deflector 21 then the ion pulse would travel forever within the closed circuit path 8.

Within the closed circuit path 8, the ion pulse travels from the output 16 of the deflector 13 to the input 20 of the deflector 21 during a time delay of 33.3 $\mu$s which corresponds to 667 clock pulses. This means that the ion pulse will reach for the first time the input 20 of the deflector 21 at the 1333rd clock pulse. As an ion pulse can complete a turn within the closed circuit path 8 in about 100 $\mu$s which means in about 2000 clock pulses, then this ion pulse will pass at the input 20 of the deflector 21 every 2000 successive clock pulses which means at the 3333rd clock pulse, 5333rd clock pulse, 7333rd clock pulse . . . , etc. The operator has to program the system so that the ion pulse be extracted from the closed circuit path 8 by applying a voltage control signal on the electrodes of the deflector 21 at least a few clock pulses before the last arrival of the ion pulse at the input 20.

Figure 6:
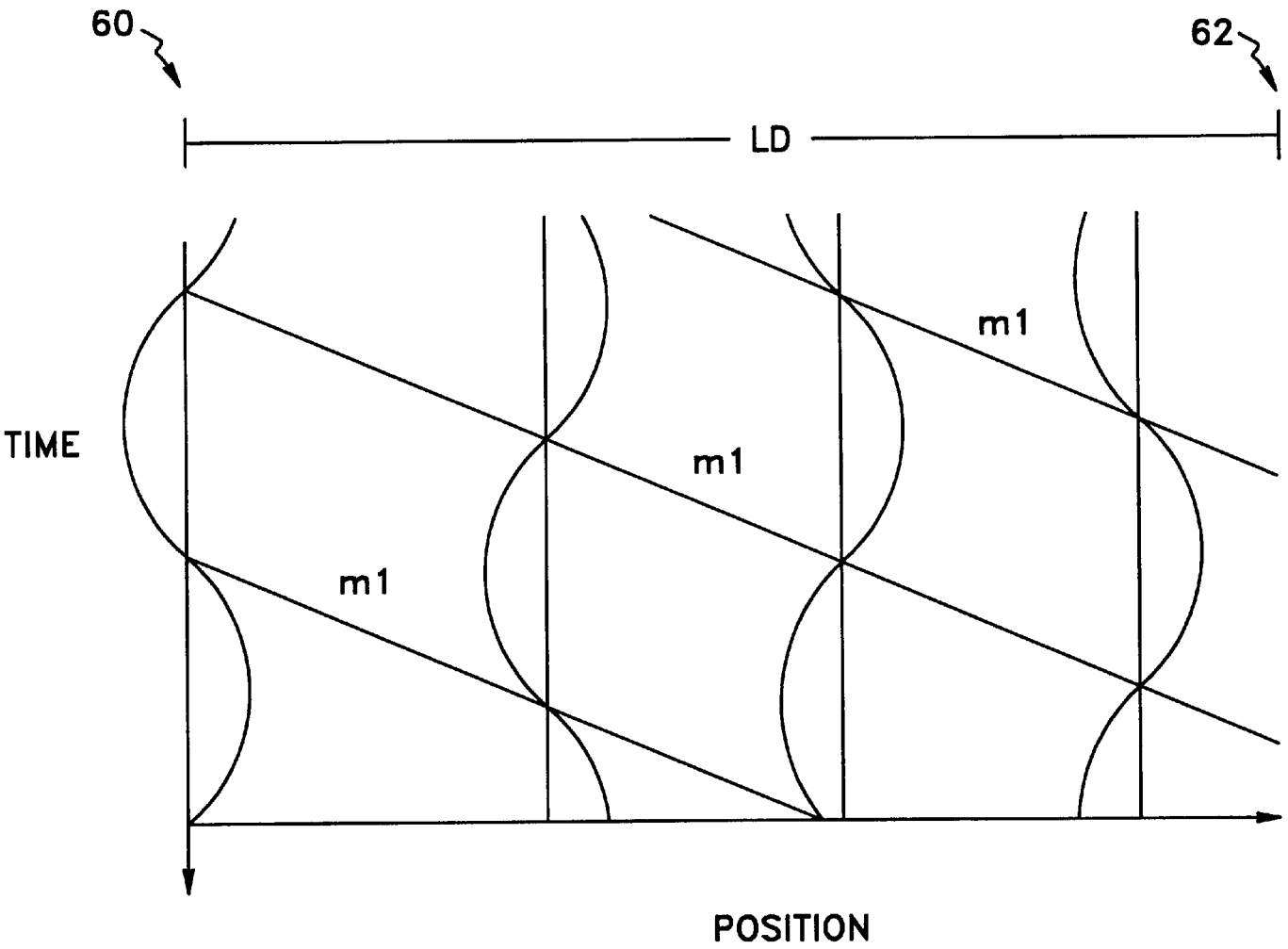
FIG. 6 is a signal diagram in relation to FIGS. 1 and 4.

Referring now to FIGS. 1, 5 and 6, we will now explain the control signals shown respectively in FIGS. 5 and 6 in relation to FIG. 1. These control signals are produced by the generator 76 for controlling the deflector 64 of the pulser 2. In FIGS. 5 and 6, there is shown in the upper part of each figure a representation of the deflector 64 which has a length LD, an input 60 and an output 62. This representation of the deflector is useful for understanding at which positions are the electrodes of the deflectors that receive the corresponding control signals.

The normal mode of operation is to feed the deflector with a periodic control signal and hence to process and analyse ion pulses also in a periodic manner, cumulating or averaging the signals received serially at the detector. In a case where the operator does not care about the ions that are deflected by the deflector 64, the control signal shown in FIG. 6 is sufficient. The ions will then be deflected astray from axis 48 and will describe different parabolas according to the intensity of the local electric field to which they will be subjected during their travel through the deflector 47. On the other hand, if the operator wants to make the measurement of the deflected ion current, the control signals shown in FIG. 5 are used so that the deflected ions are deflected alternatively toward one of the collectors 114. The parameters of the control signal shown in FIG. 5 are determined in relation to the polarity of the charged ions and the polarity of the electric field that is produced. The control signal shown in FIG. 5 is useful in a case where the operator wants to measure the ion beam entering within the pulser with respect to the pulsed ions exiting from the pulser.

In FIG. 5, the periodic voltage signals applied to two adjacent pairs of electric wires are slightly dephased with one another. This phase shifting of the periodic voltage signals applied to adjacent pairs of electric wires corresponds to the velocity of the desired ions. Hence, the periodic voltage signals induce a moving electric field having nil electric field zones moving at a uniform velocity along the axis of the deflector 64. Thus, ions that enter the deflector 64 when the electric field is nil and have the same velocity as the velocity of this travelling nil field zone are not deflected, the remaining ions of the incoming beam are deflected away from the central axis of the deflector 64. The pulsed ions that are not deflected continue towards the deflector 47.

In FIG. 6, along the position axis, there is a series of sinusoidal voltage signals each applied to a corresponding pair of wires. The diagonal lines represent the trajectory of ions having the mass m1. These ions have a velocity within the range of the desired ions. If these ions enter the deflector 64 when the control signal applied to the first pair of wires is nil then they will continue straight ahead towards the output, the remaining ions of the beam being deflected.

When a sinusoidal voltage control signal is used, the deflected ions are sent in a sector ranging from an angle range of $+\alpha$ and $-\alpha$ across the central axis of the deflector 64. The value of a is a function of the amplitude of the applied control signal, the energy of the incoming beam and the length LD of the deflector 64. This can be calculated by means of well known electro-optical formulae. The ions that are deflected hit metallic sheets located around the output slit that allow the selected ions to continue towards the deflector 47.

When voltage control signals as shown in FIG. 5 are used, the incoming ion beam is deflected, most of the time, by an angle of $\alpha$ from the central axis of the deflector 64, and, for a short period, is directed towards the output slit, thus producing pulsed ions. The value of $\alpha$ is a function of the voltage control signal, the energy of incoming ions and the length LD of the deflector 64. This can be calculated by means of well known formulae. The deflected ions all have the same deflection angle $\alpha$ allowing for their collection by means of one of the collectors 114. These collected ions provide information about the incoming ion beam such as its intensity.

Referring to FIG. 1, the pulser 2 produces periodic pulses of undeflected ions which are subsequently received by the deflector 47 which is the input of the insertion device for the closed circuit path. Deflector 47 may be activated and deflect every pulse received or only one out of N pulses. These deflected pulses are subsequently received by deflector 13 which is the output of the insertion device for the closed circuit path. The control of the deflector 13 is synchronized with the control of the deflector 47 in such a way that the pulses deflected by deflector 47 and realigned by deflector 13 enter the closed circuit path correctly with a minimum loss of intensity and are kept within it. The controls of the deflectors 21 and 70 which are respectively the input and the output of the extraction device from the closed circuit path, are similarly synchronized.

Figure 7:
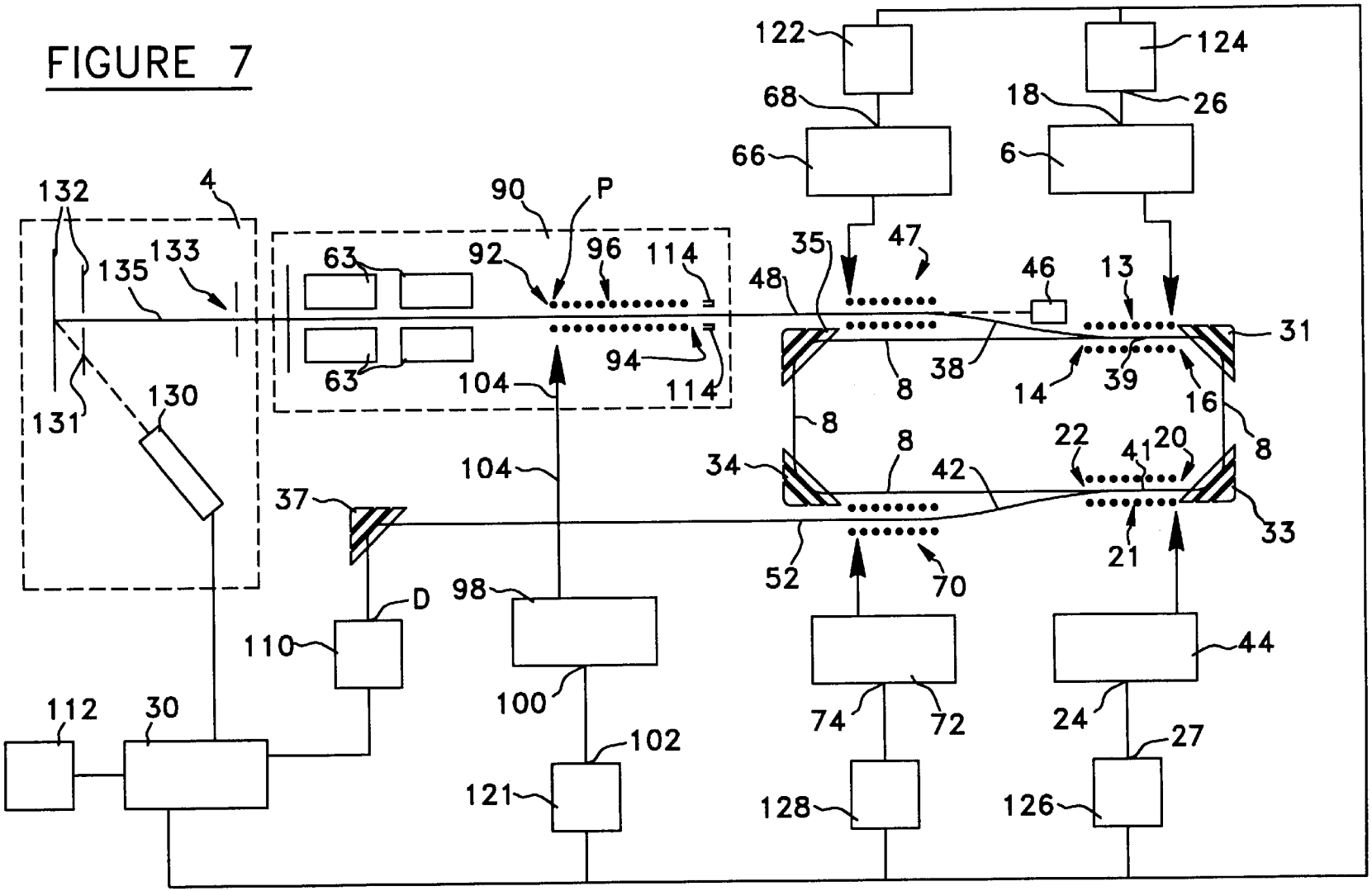
FIG. 7 is a block diagram showing an apparatus for separating pulsed ions by mass, the apparatus including a band-pass filter for selecting ions according to a given mass range, and an apparatus for producing an ion beam wherein the ions have substantially a same energy E being also shown.

Referring now to FIG. 7, there is shown another embodiment of the apparatus for separating where it comprises a band-pass filter 90 for filtering ions according to their mass m within a mass range of $m_{min}$ to $m_{max}$. The ions have substantially a same energy E. The band-pass filter 90 is located between the point P and the deflector 47.

The band-pass filter 90 comprises an input 92 for receiving the pulsed ions, and an output 94 for outputting pulsed and filtered ions. The path along which the ion beam travels is located between the input 92 and the output 94. The band-pass filter 90 also comprises a deflector 96 located between the input 92 and the output 94 nearby the path. The material structure of this deflector 96 is similar to the one shown in FIG. 4.

A DC voltage generator 98 is provided for controlling the deflector 96. It has a command input 100 for receiving a control signal from an output 102 of the controller 3, the output 102 being provided by a delay generator 121. The voltage generator 98 has also several DC voltage outputs 104 respectively connected to the pairs of electrodes of the deflector 96 for applying respectively several delayed DC voltages between the electrodes of each pair of electrodes to produce a moving electric field having a window opening travelling along the path with a predetermined speed. This speed is determined by the average speed of the incoming ions in the small mass range $m_{min}$ to $m_{max}$ that is to be filtered. The window opening of the nil travelling field and its predetermined speed are determined in relation to the mass range $m_{min}$ to $m_{max}$ that is to be filtered. The temporal synchronization shown in FIGS. 3A, 3B, 3C, 3D and 3E can also be applied to apparatus shown in FIG. 7. In that case, each of the zero volt signals shown in FIG. 3A is applied to the input of the generator 98 which, for each zero volt signal that is received, generates control signals as shown in FIG. 8.

The whole apparatus shown in FIG. 7 is for analysing pulsed ions produced by apparatus 4 in which a sample is bombarded by means of a pulsed laser or ion beam 131 generated by a pulsed source 130. The pulsed ions of beam 135 induced from the bombarding are accelerated by means of plates 132 and directed toward the band-pass filter 90 via an output slot 133. The band-pass filter comprises quadrupolar lenses 63 for horizontally and vertically focussing the incoming ion beam. The pass band of the band-pass filter 90 is controllable. This band-pass filter is useful for eliminating ions having unwanted masses. The band-pass filter 90 allows only the ions that have the desired range of velocities (or masses) to go through as determined by setting both the width of the window in the filter and the shifting frequency over the pair of successive wires. The unwanted ions are collected by means of collectors 114.

The operator can determine in advance the resolving power of the system. A higher resolving power is obtained by keeping the pulsed ions within the closed circuit path 8 for a greater number of turns. The deflectors 47, 13, 21 and 70 are used for inserting the pulsed ions within the closed circuit path 8 and for extracting the pulsed ions thereof. Each pulse of pulsed ions constitutes an experiment in itself. The frequency at which the pulsed ions are generated which is the frequency at which the experiment is repeated depends on the resolving power that is needed.

Figure 8:
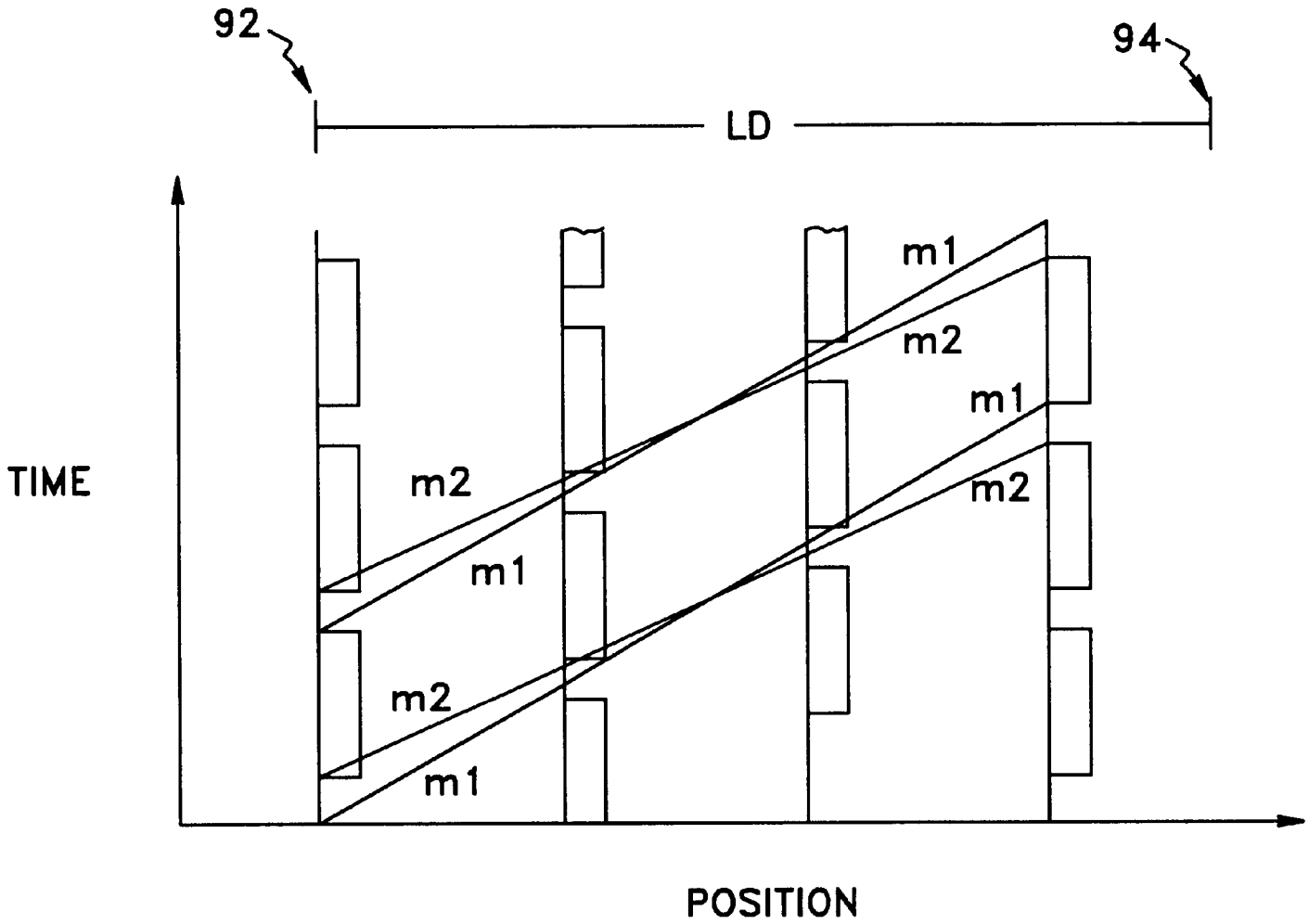
FIG. 8 is a signal diagram in relation to FIGS. 4 and 7.

We will now refer to FIGS. 7 and 8 to describe the voltage control signals shown in FIG. 8 in relation to FIG. 7. The voltage signals of FIG. 8 are applied to the pairs of wires of the deflector 96. The object of the deflector 96 is to eliminate ions having a mass outside of a given range. The ion masses are directly related to their speed as they have substantially a same energy E. Along the position axis of FIG. 8, there is a series of voltage pulse trains each applied to a corresponding electric pair of wires of the deflector 96. In the upper part of FIG. 8, there are shown where the input 92, the output 94 and the length LD of the deflector 96 are located with respect to the voltage pulse trains. The diagonal lines m1 and m2 delimit the axis position with respect to time of ions having their masses within the range m1 and m2. These masses m1 and m2 correspond respectively to ions having velocities within the range v1 and v2. The range of masses m1 and m2 corresponds to the range of masses that is filtered by the band-pass filter 90. Ions having their masses within the range m1 and m2 pass in between the wires of each pair of electrodes and, as they pass, the ambient electric field is nil.

The periodic voltage control signals applied to two adjacent pairs of electric wires are slightly delayed with one another. This delay between pairs of electric wires corresponds to a velocity v in the range v1 and v2. The maximum duty cycle will be obtained when a nil field zone moving along the deflector 96 will be associated with each ion pulse produced by the laser.

The ions having the desired masses are not deflected if they enter into the deflector when the voltage applied to the first pair of wires is nil. Thus, ions which have about the same velocity as the one of the nil field zones or adjacent velocities depending on the window opening of the voltage signals are not deflected by the moving electric field, while other ions entering in the input 92 when the electric field is applied are deflected away from the central axis of the deflector 96. The ions that are not deflected are sent towards the deflector 47.

Furthermore, the ions that enter into the input 92 but have a velocity outside of the range v1 and v2 are eventually deflected as they travel along the deflector 96. The deflected ions are all deflected according to a same deflection angle allowing for their collection by the collectors 114.

Although the present invention has been explained hereinafter by way of preferred embodiments thereof, it should be pointed out that any modifications to these preferred embodiments, within the scope of the appended claims, are not deemed to change or alter the nature and scope of the present invention.

What is claimed is:

1. An apparatus for separating ions of a pulse by mass as said ions are guided along a course, each of the ions having a mass m within a range $m_{min}$ to $m_{max}$, a same energy E, and a speed v given by $v=(2E/m)^{1/2}$, the ions passing a point P at a time T0, said apparatus comprising:

guiding means for energy-isochronally guiding ions of a same mass along a closed circuit path having a course length L;

insertion means having an insertion input for receiving the ions, an insertion output for inserting the ions deflected from the insertion input into the closed circuit path and a first control gate for either activating or deactivating the insertion means, the insertion input being located at a distance L1 from the point P;

extraction means having an extraction input for receiving the ions guided along the closed circuit path, an extraction output for extracting the ions out of the closed circuit path and a first control gate for either activating or deactivating the extraction means, the extraction input being located at a course distance L2 from the insertion input; and controlling means having:

a first output for sending a first control signal to the first control gate of the insertion means at a time T1, to activate the insertion means and consequently insert the ions present at the input thereof, T1 being chosen within limits defined by the following equation:

$$T0 \leq T1 < T0 + L1/v_{max}, \text{ where } v_{max} = (2E/m_{min})^{1/2};$$

a second output for sending a second control signal to the first control gate of the insertion means to deactivate the insertion means at a time T2, T2 being chosen within limits defined by the following equation:

$$T0 + L1/v_{min} < T2 < T0 + (L+L1)/v_{max}, \text{ where } v_{min} = (2E/m_{max})^{1/2};$$

a third output for sending a third control signal to the first control gate of the extraction means at a time T3 to activate the extraction means and consequently extract the ions present at the input thereof, T3 being chosen within limits defined by the following equation:

$$T0 + L1/v_{min} + (((n-1)L + L2)/v_{min}) < T3 < T0 + L1/v_{max} + (nL + L2)/v_{max},$$

where n is a number of turns the pulsed ions travel within the closed circuit path; and a fourth output for sending a fourth control signal to the first control gate of the extraction means at a time T4 to deactivate the extraction means, T4 being chosen within limits defined by the following equation:

$$T0 + L1/v_{min} + ((nL + L2)/v_{min}) < T4.$$

2. An apparatus according to claim 1, wherein the closed circuit path has a generally rectangular shape comprising two long opposite sides and four rounded corners, and wherein the guiding means includes four deflecting means located at the said corners of the closed circuit path, each of the deflecting means deflecting the pulsed ions at a substantially 90° angle.

3. An apparatus according to claim 2, wherein:

the insertion means include:

a first deflector located on one of the long sides of the closed circuit path, the first deflector being for deflecting pulsed ions arriving along a first axis into a second axis included in the closed circuit path, the second axis forming an obtuse angle with respect to the first axis, the first deflector comprising facing electrodes; and a first DC voltage generator for applying a first DC voltage between the facing electrodes of the first deflector upon reception of the first control signal on the first control gate of the insertion means, the first DC voltage being removed when the second control signal is applied to the first control gate of the insertion means; and the extraction means includes:

a second deflector located on the other long side of the closed circuit path, the second deflector being for deflecting pulsed ions arriving along a third axis included in the closed circuit path into a fourth axis out of the closed circuit path, the fourth axis forming an obtuse angle with respect to the third axis, the second deflector comprising facing electrodes; and a second DC voltage generator for applying a second DC voltage between the facing electrodes of the second deflector upon reception of the third control signal on the first control gate of the extraction means, the second DC voltage being removed when the fourth control signal is applied to the first control gate of the extraction means.

4. An apparatus according to claim 3, wherein:

the insertion means further include:

a third deflector for deflecting pulsed ions arriving along a fifth axis into the first axis, the fifth axis being parallel to the second axis, the third deflector comprising facing electrodes;

a third DC voltage generator for applying a third DC voltage between the facing electrodes of the third deflector upon reception of a fifth control signal on a second control gate of the insertion means, the third DC voltage being removed when a sixth control signal is applied to the second control gate of the insertion means; and the extraction means further includes:

a fourth deflector for deflecting pulsed ions arriving along the fourth axis into a sixth axis, the sixth axis being parallel to the third axis, the fourth deflector comprising facing electrodes; and a fourth DC voltage generator for applying a fourth DC voltage between the facing electrodes of the fourth deflector upon reception of a seventh control signal on a second control gate of the extraction means, the fourth DC voltage being removed when an eighth control signal is applied to the second control gate of the extraction means.

5. An apparatus according to claim 4, wherein:

each of the four deflecting means of the isochronous guiding means is a grid-free mirror;

the apparatus further comprises another grid-free mirror for deflecting pulsed ions coming from the fourth deflector along the sixth axis, this other grid-free mirror being external to the closed circuit path and having characteristics complementary to the ones of the grid-free mirrors located in the last half of the closed circuit path for maintaining an isochronous propagation among the pulsed ions extracted from the closed circuit path.

6. An apparatus according to claim 5, wherein:

the facing electrodes of each of the deflectors comprises pairs of first and second electrodes, each of the electrodes being an electrical wire, the first electrodes being parallel and lying in a first plane, the second electrodes being parallel and lying in a second plane facing the first plane, the planes being located on both sides of a path along which the pulsed ions travel;

each of the electrodes having a width of substantially 0.8 mm;

adjacent electrodes of the first electrodes and adjacent electrodes of the second electrodes are separated by a distance of substantially 1.5 mm; and the planes are separated by a distance of substantially 1 cm.

7. An apparatus according to claim 1, further comprising a pulser for producing a pulsed ion beam, the pulser comprising:

an input for receiving a continuous ion beam, the input of the pulser being located at the point P;

an output for outputting a pulsed ion beam;

deflection means located between the input and the output nearby a path along which ions travel within the pulser, comprising at least one pair of facing electrodes mounted along the path, the electrodes of each pair being located on both sides of the path and symmetrically about the path; and a DC voltage generator having a command input for receiving a control signal from a fifth output of the controlling means, and a DC voltage output connected to the electrodes for applying a fifth DC voltage between the electrodes of each pair of electrodes, whereby the continuous ion beam is pulsed by applying a discontinuous electric field along the path by means of the electrodes of the deflection means.

8. An apparatus according to claim 7, wherein:

the closed circuit path has a generally rectangular shape comprising two long opposite sides and four rounded corners, and wherein the guiding means includes four deflecting means located at the said corners of the closed circuit path, each of the deflecting means deflecting the pulsed ions at a substantially 90° angle;

the insertion means include:

a first deflector located on one of the long sides of the closed circuit path, the first deflector being for deflecting pulsed ions arriving along a first axis into a second axis included in the closed circuit path, the second axis forming an obtuse angle with respect to the first axis, the first deflector comprising facing electrodes; and a first DC voltage generator for applying a first DC voltage between the facing electrodes of the first deflector upon reception of the first control signal on the first control gate of the insertion means, the first DC voltage being removed when the second control signal is applied to the first control gate of the insertion means;

the extraction means includes:

a second deflector located on the other long side of the closed circuit path, the second deflector being for deflecting pulsed ions arriving along a third axis included in the closed circuit path into a fourth axis out of the closed circuit path, the fourth axis forming an obtuse angle with respect to the third axis, the second deflector comprising facing electrodes; and a second DC voltage generator for applying a second DC voltage between the facing electrodes of the second deflector upon reception of the third control signal on the first control gate of the extraction means, the second DC voltage being removed when the fourth control signal is applied to the first control gate of the extraction means;

the insertion means further include:

a third deflector for deflecting pulsed ions arriving along a fifth axis into the first axis, the fifth axis being parallel to the second axis, the third deflector comprising facing electrodes;

a third DC voltage generator for applying a third DC voltage between the facing electrodes of the third deflector upon reception of a fifth control signal on a second control gate of the insertion means, the third DC voltage being removed when a sixth control signal is applied to the second control gate of the insertion means;

the extraction means further includes:

a fourth deflector for deflecting pulsed ions arriving along the fourth axis into a sixth axis, the sixth axis being parallel to the third axis, the fourth deflector comprising facing electrodes; and a fourth DC voltage generator for applying a fourth DC voltage between the facing electrodes of the fourth deflector upon reception of a seventh control signal on a second control gate of the extraction means, the fourth DC voltage being removed when an eighth control signal is applied to the second control gate of the extraction means;

each of the four deflecting means of the isochronous guiding means is a grid-free mirror;

the apparatus further comprises another grid-free mirror for deflecting pulsed ions coming from the fourth deflector along the sixth axis, this other grid-free mirror being external to the closed circuit path and having characteristics complementary to the ones of the grid-free mirrors located in the last half of the closed circuit path for maintaining an isochronous propagation among the pulsed ions extracted from the closed circuit path;

the facing electrodes of each of the deflectors comprises pairs of first and second electrodes, each of the electrodes being an electrical wire, the first electrodes being parallel and lying in a first plane, the second electrodes being parallel and lying in a second plane facing the first plane, the planes being located on both sides of a path along which the pulsed ions travel;

each of the electrodes having a width of substantially 0.8 mm;

adjacent electrodes of the first electrodes and adjacent electrodes of the second electrodes are separated by a distance of substantially 1.5 mm; and the planes are separated by a distance of substantially 1 cm.

9. An apparatus according to claim 1, wherein the apparatus further comprises a band-pass filter for filtering ions according to their mass m within a mass range of $m_{min}$ to $m_{max}$, the ions having substantially a same energy E, the band-pass filter being located between the point P and the insertion input, the band-pass filter comprising:

an input for receiving an ion beam;

an output for outputting a filtered ion beam, a path along which the ion beam travel being located between the input and the output;

deflection means located between the input and the output nearby a path along which ions travel within the band-pass filter, comprising a plurality of pairs of facing electrodes mounted along the path, the electrodes of each pair being located on both sides of the path and symmetrically about the path;

a DC voltage generator having a command input for receiving a control signal from a fifth output of the controlling means, and several DC voltage outputs respectively connected to the pairs of electrodes for applying respectively several delayed DC voltages between the electrodes of each pair of electrodes to produce a moving electric field having a window opening travelling along the path with a predetermined speed, the predetermined speed and the window opening being determined according to the mass range $m_{min}$ to $m_{max}$.

10. An apparatus according to claim 9, wherein:

the closed circuit path has a generally rectangular shape comprising two long opposite sides and four rounded corners, and wherein the guiding means includes four deflecting means located at the said corners of the closed circuit path, each of the deflecting means deflecting the pulsed ions at a substantially 90° angle;

the insertion means include:

a first deflector located on one of the long sides of the closed circuit path, the first deflector being for deflecting pulsed ions arriving along a first axis into a second axis included in the closed circuit path, the second axis forming an obtuse angle with respect to the first axis, the first deflector comprising facing electrodes; and a first DC voltage generator for applying a first DC voltage between the facing electrodes of the first deflector upon reception of the first control signal on the first control gate of the insertion means, the first DC voltage being removed when the second control signal is applied to the first control gate of the insertion means;

the extraction means includes:

a second deflector located on the other long side of the closed circuit path, the second deflector being for deflecting pulsed ions arriving along a third axis included in the closed circuit path into a fourth axis out of the closed circuit path, the fourth axis forming an obtuse angle with respect to the third axis, the second deflector comprising facing electrodes; and a second DC voltage generator for applying a second DC voltage between the facing electrodes of the second deflector upon reception of the third control signal on the first control gate of the extraction means, the second DC voltage being removed when the fourth control signal is applied to the first control gate of the extraction means;

the insertion means further include:

a third deflector for deflecting pulsed ions arriving along a fifth axis into the first axis, the fifth axis being parallel to the second axis, the third deflector comprising facing electrodes;

a third DC voltage generator for applying a third DC voltage between the facing electrodes of the third deflector upon reception of a fifth control signal on a second control gate of the insertion means, the third DC voltage being removed when a sixth control signal is applied to the second control gate of the insertion means;

the extraction means further includes:

a fourth deflector for deflecting pulsed ions arriving along the fourth axis into a sixth axis, the sixth axis being parallel to the third axis, the fourth deflector comprising facing electrodes; and a fourth DC voltage generator for applying a fourth DC voltage between the facing electrodes of the fourth deflector upon reception of a seventh control signal on a second control gate of the extraction means, the fourth DC voltage being removed when an eighth control signal is applied to the second control gate of the extraction means;

each of the four deflecting means of the isochronous guiding means is a grid-free mirror;

the apparatus further comprises an other grid-free mirror for deflecting pulsed ions coming from the fourth deflector along the sixth axis, this other grid-free mirror being external to the closed circuit path and having characteristics complementary to the ones of the grid-free mirrors located in the last half of the closed circuit path for maintaining an isochronous propagation among the pulsed ions extracted from the closed circuit path;

the facing electrodes of each of the deflectors comprises pairs of first and second electrodes, each of the electrodes being an electrical wire, the first electrodes being parallel and lying in a first plane, the second electrodes being parallel and lying in a second plane facing the first plane, the planes being located on both sides of a path along which the pulsed ions travel;

each of the electrodes having a width of substantially 0.8 mm;

adjacent electrodes of the first electrodes and adjacent electrodes of the second electrodes are separated by a distance of substantially 1.5 mm; and the planes are separated by a distance of substantially 1 cm.

11. A method for separating ions of a pulse by mass as said ions are guided along a course, each of the ions having a mass m within a range $m_{min}$ to $m_{max}$, a same energy E, and a speed v given by $v=(2E/m)^{1/2}$, the ions passing a point P at a time T0, said method comprising steps of:

inserting a pulse of ions into a closed circuit path by means of insertion means having an insertion input for receiving the ions, an insertion output for inserting the ions deflected from the insertion input into the closed circuit path, and a first control gate for either activating or deactivating the insertion means, the insertion input being located at a distance L1 from the point P;

energy-isochronally guiding ions of a same mass along the closed circuit path having a course length L;

extracting the pulse of ions out of the closed circuit path by means of extraction means having an extraction input for receiving the ions guided along the closed circuit path, an extraction output for extracting the ions out of the closed circuit path, and a first control gate for either activating or deactivating the extraction means, the extraction input being located at a course distance L2 from the insertion input;

sending a first control signal to the first control gate of the insertion means at a time T1 to activate the insertion means and consequently insert the ions present at the input thereof, T1 being chosen within limits defined by the following equation:

$$T0<T1<T0+L1/v_{max}, \text{ where } v_{max}=(2E/m_{min})^{1/2};$$

sending a second control signal to the first control gate of the insertion means to deactivate the insertion means at a time T2, T2 being chosen within limits defined by the following equation:

$$T0+L1/v_{min}<T2<T0+(L+L1)/v_{max}, \text{ where } v_{min}=(2E/m_{max})^{1/2};$$

sending a third control signal to the first control gate of the extraction means at a time T3 to activate the extraction means and consequently extract the ions present at the input thereof, T3 being chosen within limits defined by the following equation:

$$T0+L1/v_{min}+(((n-1)L+L2)/v_{min})<T3<T0+L1/v_{max}+(nL+L2)/v_{max},$$

where n is a number of turns the pulsed ions travel within the closed circuit path; and sending a fourth control signal to the first control gate of the extraction means at a time T4 to deactivate the extraction means, T4 being chosen within limits defined by the following equation:

$$T0+L1/v_{min}+((nL+L2)/v_{min})<T4.$$

12. A method according to claim 11, wherein:

the step of inserting comprises the step of deflecting pulsed ions arriving along a first axis into a second axis included in the closed circuit path, the second axis forming an obtuse angle with respect to the first axis; and the step of extracting comprises the step of deflecting pulsed ions arriving along a third axis included in the closed circuit path into a fourth axis out of the closed circuit path, the fourth axis forming an obtuse angle with respect to the third axis.

13. A method according to claim 12, wherein:

the step of inserting further comprises, before the step of deflecting pulsed ions arriving along the first axis, a step of deflecting pulsed ions arriving along a fifth axis into the first axis, the fifth axis being parallel to the second axis; and the step of extracting further comprises, after the step of deflecting pulsed ions into the fourth axis, a step of deflecting pulsed ions arriving along the fourth axis into a sixth axis, the sixth axis being parallel to the third axis.

* * * * *